US010046936B2

(12) United States Patent
Deocon Mir et al.

(10) Patent No.: US 10,046,936 B2
(45) Date of Patent: Aug. 14, 2018

(54) STACKER DEVICE TO STACK SHEETS OF PRINT MEDIA

(71) Applicant: Hewlett-Packard Development Company, L.P., Houston, TX (US)

(72) Inventors: Xavier Deocon Mir, Sant Cugat del Valles (ES); Eduardo Martin Orue, Sant Cugat del Valles (ES); Josep Ortiz Mompel, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/954,202

(22) Filed: Nov. 30, 2015

(65) Prior Publication Data

US 2017/0152122 A1 Jun. 1, 2017

(51) Int. Cl.

| | |
|---|---|
| ***B65H 31/26*** | (2006.01) |
| ***B65H 29/70*** | (2006.01) |
| ***B65H 31/10*** | (2006.01) |
| ***B65H 43/06*** | (2006.01) |

(52) U.S. Cl.

CPC ..... *B65H 31/26* (2013.01); *B65H 29/70* (2013.01); *B65H 31/10* (2013.01); *B65H 43/06* (2013.01); *B65H 2301/5121* (2013.01); *B65H 2301/5122* (2013.01); *B65H 2301/51214* (2013.01); *B65H 2301/51256* (2013.01); *B65H 2405/115* (2013.01); *B65H 2405/1117* (2013.01); *B65H 2405/1412* (2013.01); *B65H 2801/06* (2013.01)

(58) Field of Classification Search

CPC ..... B65H 31/26; B65H 31/12; B65H 31/14; B65H 29/70; B65H 29/52; B65H 2301/521256; B65H 2301/51214; B65H 2301/5122; B65H 2301/5121

See application file for complete search history.

(56) References Cited

U.S. PATENT DOCUMENTS 4,364,553 A * 12/1982 Wilson ..... B65H 31/10 271/207
5,094,660 A * 3/1992 Okuzawa ..... B65H 29/70 271/178
7,494,121 B2 2/2009 Herrmann et al.

(Continued)

FOREIGN PATENT DOCUMENTS

JP 03018551 A * 1/1991
JP 04144877 A * 5/1992

(Continued)

OTHER PUBLICATIONS

Riso, "Highspeed paper feeding system technology", download date Nov. 13, 2015, 5 pages. https://www.riso.co.jp/english/tech_portal/core/speed.html.

*Primary Examiner* — Luis A Gonzalez
(74) *Attorney, Agent, or Firm* — HP Inc. Patent Department

(57) ABSTRACT

Stacker device to stack sheets of print media. The stacker device comprises a tray to stack the sheets. The tray comprises an M-shaped tray section to apply an M-shaped profile to a sheet along a direction perpendicular to the sheet's advance direction to reduce curling. The stacker device further comprises a roof. The roof comprises at least one adjustable roof portion to limit a height of a curl of the sheet.

17 Claims, 6 Drawing Sheets

(56) References Cited

U.S. PATENT DOCUMENTS

| | | | | |
|---|---|---|---|---|
| 7,793,932 | B1 * | 9/2010 | Bartman | B65H 31/20 271/209 |
| 9,656,484 | B2 * | 5/2017 | Boo | B41J 11/005 |
| 2011/0233853 | A1 * | 9/2011 | Naraoka | B65H 31/10 271/213 |
| 2015/0239702 | A1 | 8/2015 | Sugiyama et al. | |
| 2016/0185555 | A1 * | 6/2016 | Shinohara | B65H 29/68 358/1.12 |

FOREIGN PATENT DOCUMENTS

| | | | | |
|---|---|---|---|---|
| JP | 09255210 | A | * | 9/1997 |
| JP | 2008127199 | | | 6/2008 |
| WO | WO-2011162607 | | | 12/2011 |

* cited by examiner

STACKER DEVICE TO STACK SHEETS OF PRINT MEDIA

BACKGROUND

Stacker devices receive print media sheets and lay them down on a stack. Sheets should lie flat on the stack. However, sheets have the tendency to curl and/or to roll up itself.

BRIEF DESCRIPTION OF THE DRAWINGS

Examples will be described, by way of example only, with reference to the accompanying drawings in which corresponding reference numerals indicate corresponding parts and in which.

DETAILED DESCRIPTION

Figure 1:
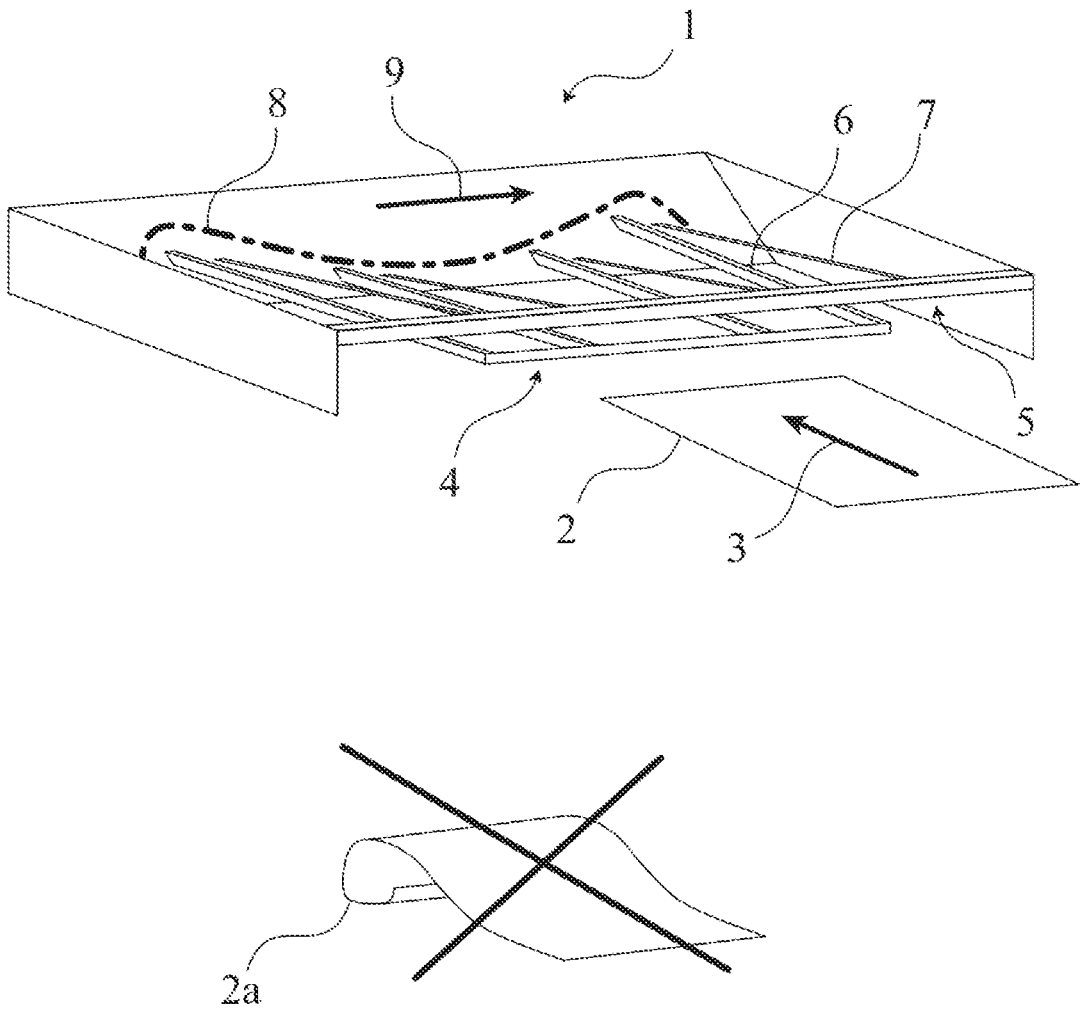
FIG. 1 is an illustration of an example stacker device.

The description refers to stacker devices for sheets of a print medium. The following example stacker devices, the example printers with stacking device and/or example methods for stacking provide curling control on a stack of sheets. The following examples are to be understood with regard to stacker devices, printers with stacker devices, and methods for stacking sheets of print media.

An example stacker device receives sheets of a print medium, e.g. from a print unit of a printer. The stacker device comprises a tray to stack the received sheets. The stacker device also comprises a roof. The tray comprises an M-shaped section to apply an M-shaped profile to a sheet along a direction perpendicular to the sheet's advance direction. The roof comprises one or more adjustable roof portions to limit a height of a curl of the sheet.

An example method of stacking one or more sheets in the example stacker device comprises forming an M-shaped profile of the sheet by advancing the sheet onto the M-shaped tray section and limiting a height of a curl of the sheet by the adjustable roof portion. The method further comprises stacking the sheet comprising the M-shaped profile at the M-shaped tray section.

The M-shaped section of the tray applies an M-shaped cross-sectional profile to sheets stacked on this section of the tray.

An M-shape may comprise (at least) a left-bending followed by a right-bending followed by a left-bending or (at least) a right-bending followed by a left-bending followed by right-bending. In some examples, an M-shape is not continuous, but it may be defined by two, three, four, five or even more points of support. For example, the M-shape of the M-shape tray can be built by two supports in a certain distance, wherein the supports correspond to the peaks of an "M". A sheet covering the two supports and extending beyond the two supports at the sheets edges may thus adopt an M-shape due to gravity.

The M-shaped profile of the sheet, wherein the M-shaped profile extends perpendicular to the direction of an advance of the sheet, increases rigidity of the sheet in this direction. This reduces the tendency of the sheet to curl or roll up when advancing the sheet in this direction. The example stacker device combining the M-shaped tray section together with the adjustable roof portion limiting a height of a (possible) curl provides a higher degree of curl prevention than these measures may achieve considered separately.

For example, when the sheet is transferred to the stacker device, the sheet tends to curl or roll up on the tray of the stacker. This tendency increases with higher print speeds, e.g. in some examples with the printer being a page wide array printer, and may result in a media jam. This jam can affect the printer media path and may result in stopping completely the printing process. The sheets' tendency to curl can be controlled by the combination of the M-shaped tray and the adjustable roof portion.

The combination of the M-shaped tray section and the adjustable roof portion may also reduce marks or scratches in printed areas by controlling the curling of the sheet. Because a sheet that has a significant amount of curl on its leading area (in the direction of the sheet's advance) tends to mark a previous sheet that lies just underneath on a stack on the tray. A leading edge with curling tends to slide almost perpendicular to the flat previous sheet acting as a razor blade on the previous sheet.

In some examples, the combination of the M-shaped tray section and the adjustable roof portion provides controlling of the sheet's tendency to curl and to roll up without affecting the capacity of the tray and/or without involving any active mechanism (e.g. a motor driven mechanism and/or mechanism based on sensors).

In some examples, the M-shaped tray section comprises two or more tray bars that extend in a direction of an advance of the sheets. For example, the tray comprises two tray bars that correspond to the two peaks of the "M" of the M-shaped tray section as described before. These two tray bars may be the topmost tray bars of multiple tray bars. In some examples, a center tray bar corresponds to the center minimum of the "M" of the M-shaped tray section. The center tray bar may be the lowermost tray bar of the two or more tray bars.

In some examples, the M-shaped tray section comprises four tray bars. For example, the four tray bars include an outer pair of tray bars and an inner pair of tray bars arranged between the outer pair of tray bars. Thereby, the tray can form sheets of different sizes into the desired M-shaped profile, as sheets smaller than a distance between the outer pair of tray bars can be supported by the inner pair of tray bars but not by the outer pair of trays. As described before, sheets supported by the two inner tray bars may adopt the M-shape due to gravity. Furthermore, bigger sheets extending beyond the outer pair of tray bars can be additionally supported by the inner pair of tray bars. This may prevent large sheets from sliding through a gap between the outer tray bars. In some examples, the four tray bars are to stack sheets in a landscape or in a portrait orientation by using either two of four or four tray bars to support the sheet.

An adjustable roof portion may be aligned with a tray bar. In some examples, an adjustable roof portion is directly located above an associated tray bar in a vertical direction. The sheets may be guided between the tray bar and the adjustable roof portion. The height of a curl of a sheet can be controlled by the distance between the adjustable roof portion and the associated tray bar.

In some examples, the tray further comprises a flat tray section arranged before the M-shaped section along a direction of an advance of the sheets. The flat section may be a receiving section for receiving sheets, e.g. from a print unit of a printer. Sheets may be received by the flat section of the tray with a (substantially) flat profile perpendicular to their direction of advance. This flat profile may be converted into the M-shaped profile by the M-shaped tray section when the sheet advances from the flat section to the M-shaped tray section. A sequence of a flat tray section followed by an M-shaped tray sections enables the stacker device to form flat sheets into M-shaped sheets merely by the advance of the sheets.

In some examples, in order to stack sheets longer than the tray length, the tray further comprises a rigid cylindrical surface at its distal end with regard to the direction of advance of the sheets. The cylindrical surface provides a flat profile in a direction perpendicular to the sheet advance direction. Thereby, the M-shape applied by the M-shaped tray section may be removed by the cylindrical surface (following the M-shaped section in the sheet advance direction) and sheets can hang freely past the tray's end. The curling naturally present on sheets bends a sheet's leading edge down, leaving room for a next sheet to hang.

In some examples, an adjustable roof portion may continually contact the stack of sheets supported by the tray. In order to, for example, minimize the curling height and/or help the media to form into the desired M-shape profile, the adjustable roof portion (continually) applies a force pressing the sheets against the (M-shaped) tray, e.g. against its associated tray bar. In some examples, an adjustable roof portion includes a pivotable lever or arm to press the sheets against the tray. The adjustable roof portion may comprise a wheel or a roller to contact the sheets. The wheel or roller can reduce friction between the adjustable roof portion and the sheets.

In some examples, the adjustable roof portion is adjustable in order not to limit the capacity of the stacker device. In some examples, the adjustable roof portion is moved up by the sheets itself, e.g. by the stack of sheets growing by stacking further sheets. The stacker device may include a sensor to detect an upper position of the adjustable roof portion. The sensor may signal a maximum height of the stack of sheets, e.g. in order to stop receiving further sheets.

In some examples, the tray comprises an adjustable tray portion and a fixed tray portion. For example, the tray may be pivotable around an axis, wherein the axis defines the fixed tray portion and the pivotable portion of the tray is adjustable by pivoting the tray. The adjustable tray portion may bend down under a weight of sheets stacked on the tray. The adjustable tray portion may be faced towards where the sheets are received by the stacker device in order to keep the top of the stack of sheets at an approximately constant height, easing the landing of the received sheets on the stack.

In some examples, the roof further comprises a fixed roof portion that may support the adjustable roof portion. In some examples, in order not to limit the capacity of the stacker device, the fixed roof portion is located next to the adjustable tray portion in a vertical direction and the adjustable roof portion is located next to the fixed tray portion. The adjustable tray portion may bend down and the adjustable roof portion may bend up in order to increasing a gap between the tray and the roof for the stack growing.

In order to better match different widths of sheets, in some examples, the M-shaped tray section comprises an M-shaped sub-section in a direction transverse to the sheet advance direction. This means that the sub-section comprises an M-shape on its own and also fits into the M-shape of the (complete) M-shaped tray section. Large sheets may cover the (complete) M-shaped tray section incorporating the M-shaped sub-section. Smaller sheets may cover the M-shaped sub-section such that they are supported by the M-shaped sub-section. In order to appropriately pivot the M-shaped sub-section to keep the top of the stack at an appropriate height, the M-shaped sub-section may be pivotable independently from the remaining portion of the M-shaped tray section. In that the M-shaped tray sections comprises at least one sub-section, which is M-shaped by its own, the tray can apply M-shaped profiles to different sizes of paper and also keep stacks of such sheets at appropriate heights.

Now referring to FIG. 1, which illustrates an example stacker device 1. The stacker device 1 can receive sheets 2 of print media in a direction indicated by arrow 3 (sheet advance direction). The sheets 2 may be output by a printer and transported to the stacker device 1. The stacker device 1 has a tray 4 to support and stack sheets 2. In order to prevent the sheets 2 from curling or rolling up as illustrated by the rolled up sheet according to reference numeral 2*a*, the tray 4 has an M-shaped tray section 6 to form received sheets 2 into an M-shaped profile 8 perpendicular (as indicated by arrow 9) to the sheet advance direction 3. The M-shaped profile stiffens the sheets 2 in the direction 3 and, thus, decreases the risk of the sheets 2 curling. In the example stacker device 1 illustrated in FIG. 1, sheets 2 are even better prevented from curling in that the stacker device 1 also has a roof 5. The roof 5 has adjustable roof portions 7 to limit a height of a curl of the sheets 2.

In the example stacker device 1, the M-shaped tray section 6 has four tray bars 6 arranged according to the M-shaped profile 8. An inner pair of the tray bars 6 is lower than an outer pair of the tray bars 6. Thereby, a sheet 2 of a width larger than the distance between the outer pair of tray bars 6 bends by its own weight over the four tray bars 6 and, thereby, become formed into the desired M-shaped profile 8.

The M-shaped tray section 4 of the example stacker device 1 can also form sheets 2 of smaller width than the distance between the outer tray bars 6 into the desired M-shaped profile. Such (small) sheets 2 are supported by the inner pair of tray bars 6, but are not supported by the outer pair of tray bars 6. Thereby, sheets 2 (of small width) bend over the inner pair of tray bars 6 and, thereby, become also formed into a desired M-shaped profile.

In some example stacker devices, the tray bars 6 are located 2-3 inches to the side edge of standard sized sheets. With four tray bars 6 the M-shaped profile can be induced to most of the standard sized sheets. For example, the outer pair of tray bars [6] is located 2-3 inches to the side edges of sheets of 36 inches, 34 inches or 841 mm width. Thereby sheets of size A0, ArchE, Ansi E in a portrait orientation and A1, ArchD, Ansi D in a landscape orientation can be formed into a desired M-shape (by all four tray bars 6). The inner pair of tray bars [6] is located 2-3 inches to the side edges of sheets of 24 inches, 22 inches or 594 mm width, for example. Thereby sheets of size A1 and A2, Arch D and C, Ansi D and C in a portrait orientation and A2 and A3, Arch C and B, Ansi C and B in a landscape orientation can be formed into a desired M-shape (by the inner two tray bars 6), For example, the inner pair of tray bars [6] are at a distance of 365 mm and/or the outer pair of tray bars [6] are at a distance of 735 mm.

Turning back to the example stacker 1 illustrated in FIG. 1, as described before, the adjustable roof portions 7 limit a height of a curl of the sheets 2. The adjustable roof portions 7 are (vertically) aligned with the tray bars 6. The stacker device 1 stacks the sheets 2 between the tray bars 6, which support the stack of sheets, and the adjustable roof portions 7. In the example stacker device 1, the adjustable roof portions 7 are flexible and may bend upwards in response to the stack of sheets growing. Thus, the adjustable roof portions 7 do not limit the capacity of the stacker device 1.

The combination of the M-shaped tray section together with the adjustable roof portions 7 limiting a height of a (possible) curl provides a higher degree of curl prevention than an M-shaped tray section or a roof can separately achieve. The M-shaped section of the tray applies a corresponding M-shaped cross-sectional profile to sheets passing this section of the tray. The M-shaped profile, which extends perpendicular to the direction of an advance of the sheet when receiving the sheet by the stacker device, increases rigidity of the sheet and, thereby reduces the tendency of the sheet to curl or even roll up in the direction of advance.

Figure 2:
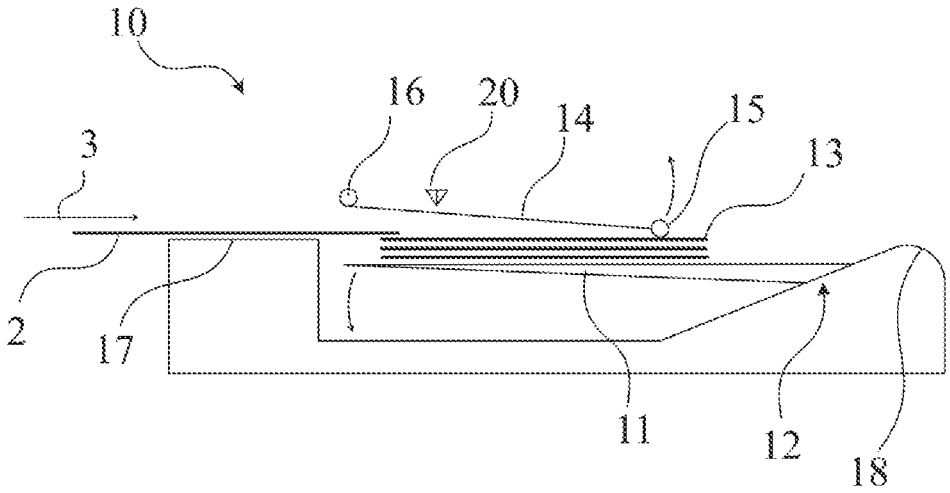
FIGS. 2-4 are illustrations of an example stacker device.

FIG. 2 illustrates a still further example stacker device 10 with a tray to stack sheets and a roof. The tray has an adjustable tray portion 11 and a fixed tray portion 12, wherein the adjustable tray portion 11 comprises an M-shaped tray section with four tray bars as described with regard to FIG. 1. The fixed tray portion 12 provides support to the adjustable tray portion 11, i.e. to the tray bars.

The roof has multiple adjustable roof portions 14 with rollers 15 to continually contact the received sheets 2 to limit a height of a curl of the received sheets 2. The adjustable roof portion 14 is pivotable around a fixed roof portion 16 of the roof in order to adjust the height of the adjustable roof portion 14. In some examples, adjustable roof portions 14 are bend down by their own weight. In some other examples, adjustable roof portions 14 are spring loaded.

Figure 3:
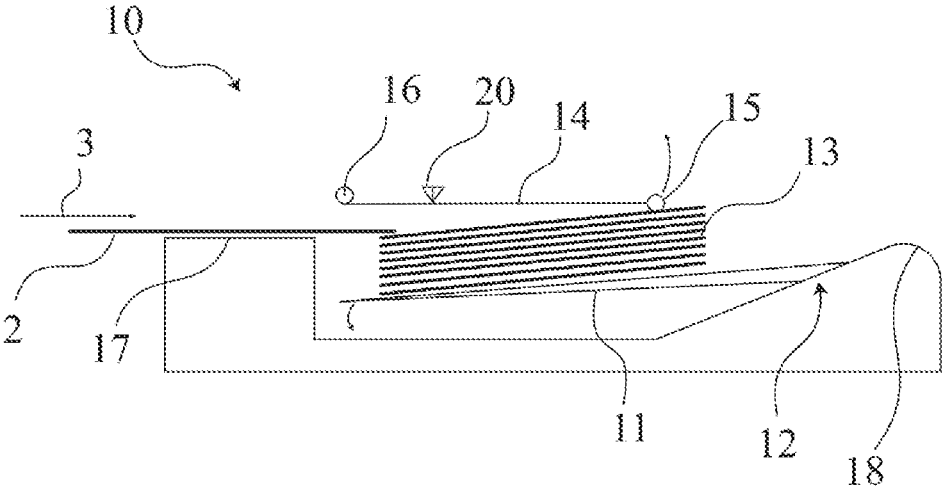

As illustrated in FIG. 3, the more sheets 2 are stacked, the more the adjustable tray portion 11 bends down under the weight of the stack 13 of sheets 2 and the adjustable roof portion 14 pivots upwards. This keeps the top of the stack 13 at an approximately constant height for receiving and stacking succeeding sheets 2 on the stack 13. The example stacker device 10 has a height sensor 20 for the adjustable roof portion 14 and/or for the adjustable tray portion 11. This enables the stacker device to detect a maximum stack height.

The inner pair of tray bars 6 and the outer pair of tray bars 6 are independently pivotable in the example stacker device 10. In that the inner pair of the tray bars 6 builds a separate M-shaped sub-section of the adjustable tray portion 11, the adjustable tray portion 11 is adapted to different weights of smaller sheets 2 covering the inner pair of tray bars 6 and also of larger sheets 2 covering both the inner and outer pairs of tray bars 6 simultaneously. Thereby, the top of the stack can be kept at an approximately constant height for both stacks 13 of small sheets 2 or stacks of large sheets 2.

The example stacker device 10 further has a flat tray section 17 that is arranged in front of the M-shaped tray section (which is the adjustable tray portion 11 in this example) along the sheet advance direction 3. The flat tray section 17 is for receiving sheets 2, e.g. from a printer, to the stacker device 10, as printers deliver sheets with a flat profile perpendicular to the sheets' advance. Therefore, from the perspective of a sheet being transported to the example stacker device 10, the tray starts flat where the sheet arrives at the stacker device 10, namely at the flat tray section 17. As the sheet 2 advances, the tray bars (as described with regard to FIG. 1) of the M-shaped tray section 11 start raising up to create the desired M-shaped profile of the sheet 2.

Figure 4:
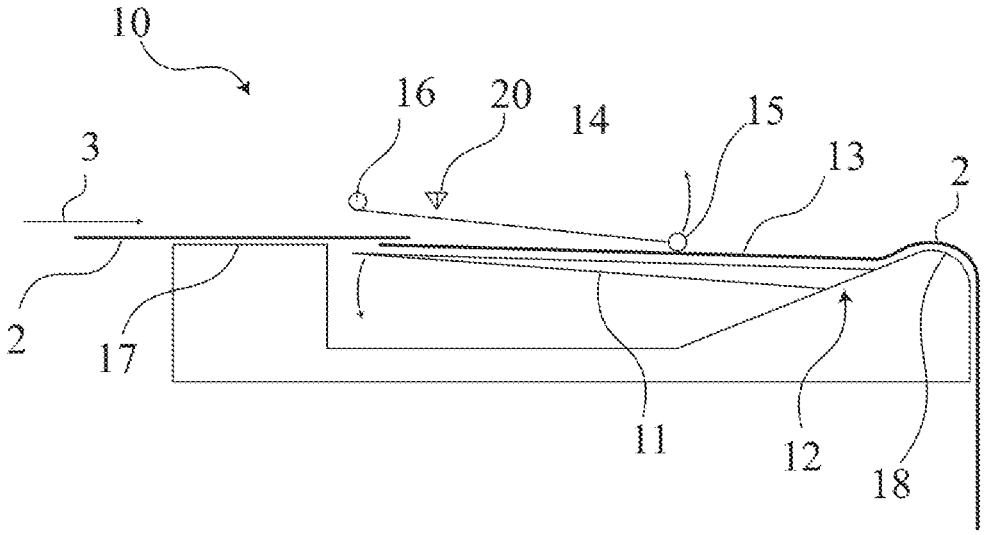

FIG. 4 illustrates the stacker device 10 of FIGS. 2 and 3 receiving sheets 2 longer than the tray. In order to stack sheets longer as the tray length, the tray ends with a rigid cylindrical surface 18 of the fixed tray portion 12. As described before, the fixed tray portion 12 provides support to the adjustable tray portion 11. In addition, the fixed tray portion 12 also progressively removes the M-shape on the sheets 2 by the cylindrical surface 18, when the sheet leafs the M-shaped tray section 11. The curling naturally present on the sheets 2 bends the leading edge down and the sheets 2 can hang freely past the tray's end.

Figure 5:
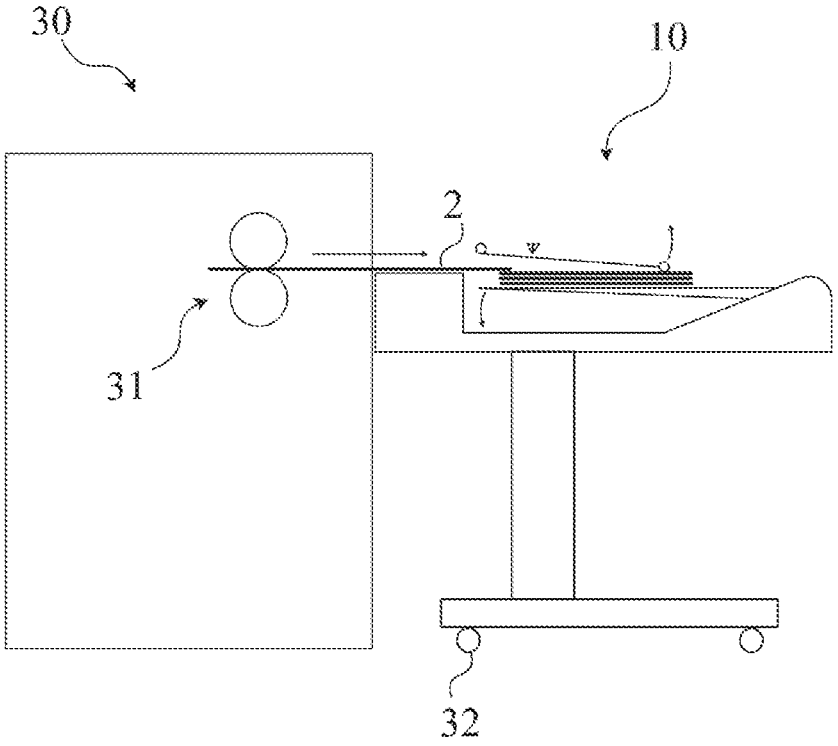
FIG. 5 is an illustration of an example printer with a stacker device.

FIG. 5 illustrates a printer 30 with a stacker device 10 as described before. The stacker device 10 receives sheets 2 printed by a print unit 31 of the printer 30. In some examples, the stacker device 10 is separate to printer 30. For example, the stacker is movable by wheels 32. Thereby, the stacker device 30 can be used with different printers 30. In some other examples, the stacker device 10 is integrated with the printer 30.

Figure 6:
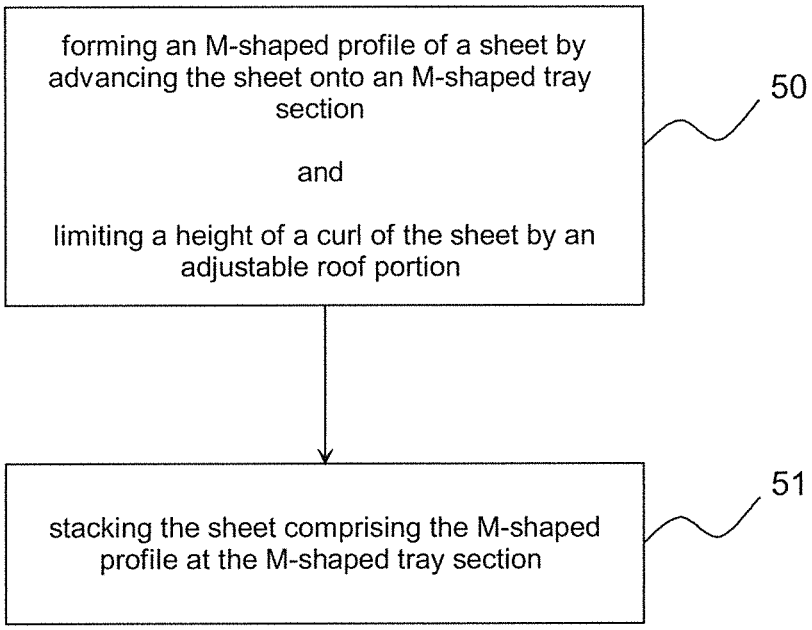
FIG. 6 shows a block diagram of an example method for stacking sheets in an example stacker device.

FIG. 6 shows a block diagram of an example method for stacking sheets in the example stacker device 10. In block 50, an M-shaped profile of a sheet 2 is formed by the sheet 2 advancing onto the M-shaped tray section 11. At the same time, a height of a curl of the sheet 2 is limited by the adjustable roof portions 7. In block 51, the sheet 2 now comprising the desired M-shaped profile (perpendicular to the sheet's advance direction) is stacked at the M-shaped tray section.

Although certain methods and products have been described herein, the scope of coverage of this patent is not limited thereto. On the contrary, this patent covers all embodiments fairly falling within the scope of the appended claims either literally or under the doctrine of equivalents.

The invention claimed is:

1. A stacker device to stack sheets of print media, the stacker device comprising:

a tray to stack the sheets, the tray comprising a rigid cylindrical surface at its end in the sheet advance direction and an M-shaped tray section to apply an M-shaped profile to a sheet along a direction perpendicular to the sheet's advance direction to reduce curling, and a roof comprising at least one adjustable roof portion to limit a height of a curl of the sheet, wherein the M-shaped tray section comprises at least two tray bars extending along the sheet advance direction.

2. The stacker device according to claim 1, wherein the at least one adjustable roof portion is aligned with the at least two tray bars.

3. The stacker device according to claim 1, the tray further comprising a flat tray section before the M-shaped tray section along the sheet advance direction.

4. The stacker device according to claim 1, the at least one adjustable roof portion to continually contact the stack of sheets.

5. The stacker device according to claim 1, the tray further comprising an adjustable tray portion and a fixed tray portion.

6. The stacker device according to claim 5, the adjustable tray portion to bend down under a weight of the stacked sheets.

7. The stacker device according to claim 1, the roof further comprising a fixed roof portion.

8. The stacker device according to claim 1, the at least one adjustable roof portion to bend upwards.

9. The stacker device according to claim 1, wherein the M-shaped tray section comprises a sub-section in a direction transverse to the sheet advance direction, wherein the sub-section comprises an M-shape to apply an M-shaped profile to a second sheet perpendicular to the second sheet's advance direction.

10. The stacker device of claim 9, wherein the sub-section is pivotable independently from the M-shaped tray section.

11. The stacker device of claim 9, wherein the sub-section comprises at least two tray bars extending along the sheet advance direction.

12. The stacker device of claim 9, where the M-shaped tray section accommodates sheets having a width exceeding a first size and wherein the subsection accommodates sheets having a width falling below a second size.

13. The printer of claim 1, wherein the roof bends down based on one of the weight of the roof and a spring.

14. A printer comprising a stacker device to stack sheets of print media, the stacker device comprising:

a tray to stack the sheets, the tray comprising an M-shaped tray section to apply an M-shaped profile to a sheet along a direction perpendicular to the sheet's advance direction to reduce curling, the tray comprising an adjustable tray portion, a fixed tray portion, and a rigid cylindrical surface at its end in the sheet advance direction, and a roof comprising at least one adjustable roof portion to limit a height of a curl of the sheet.

15. The printer of claim 14, wherein the M-shaped tray section comprises at least two tray bars extending along the sheet advance direction.

16. A printer comprising a stacker device to stack sheets of print media, the stacker device comprising:

a tray to stack the sheets, the tray comprising:

an M-shaped tray section to apply an M-shaped profile to a sheet along a direction perpendicular to the sheet's advance direction to reduce curling; and an M-shaped tray sub-section in a direction transverse to the sheet advance direction, wherein the sub-section comprises an M-shape to apply an M-shaped profile to a second sheet perpendicular to the second sheet's advance direction, and wherein the sub-section is pivotable independently from the M-shaped tray section, and a roof comprising at least one adjustable roof portion to limit a height of a curl of the sheet.

17. The printer of claim 16, wherein the M-shaped tray section comprises a first pair of tray bars extending along the sheet advance direction and wherein the M-shaped tray sub-section comprises a second pair of tray bars extending along the sheet advance direction.

* * * * *